United States Patent [19]

Orcutt et al.

[11] 4,121,074

[45] Oct. 17, 1978

[54] CONDITION RESPONSIVE APPARATUS WITH MOTION TRANSFER MEMBER TO MOVABLE CONTACT ARM

[75] Inventors: John W. Orcutt, Garland, Tex.; James M. Mills, Lexington, Ky.

[73] Assignee: Texas Instruments Incorporated, Dallas, Tex.

[21] Appl. No.: 837,970

[22] Filed: Sep. 29, 1977

[51] Int. Cl.[2] ..... H01H 35/34

[52] U.S. Cl. ..... 200/83 P; 200/241; 200/283

[58] Field of Search ..... 200/241, 242, 283, 284, 200/302, 83 A, 83 N, 83 P, 83 W, 83 WM

[56] References Cited

U.S. PATENT DOCUMENTS

| | | | |
|---|---|---|---|
| 3,230,328 | 1/1966 | Chapin | 200/83 P |
| 3,335,242 | 8/1967 | Johnson | 200/83 P |
| 3,553,402 | 1/1971 | Hire | 200/83 P |

*Primary Examiner*—Gerald P. Tolin

*Attorney, Agent, or Firm*—John A. Haug; James P. McAndrews

[57] ABSTRACT

A pressure responsive electrical switch uses precalibrated snap acting monometallic or bimetallic discs freely disposed in a disc seat formed on a base member. Over pressure protection in the form of a surface spaced just beyond the normal snapped position may be provided to avoid calibration changes. A flexible thin gasket is positioned over the disc and is sealed to the base by trapping between the base and a cap which is clamped to the base. Several seal variations are shown to provide varying degrees and types of seals. A rocker member having a specially curved surface rests on a movable contact arm and transfers motion from the disc to the movable arm. A support for the movable arm has a portion which is formed with a complementary curved portion which cooperates with the rocker member and a stationary contact to limit the amount of stress imparted to the movable contact arm. Several different embodiments of precalibrated disc switches are shown including a differential pressure switch and a switch in which the disc is part of the electrical circuit.

10 Claims, 14 Drawing Figures

CONDITION RESPONSIVE APPARATUS WITH MOTION TRANSFER MEMBER TO MOVABLE CONTACT ARM

This invention relates generally to condition responsive devices, and to methods of making them, and more particularly to certain specific features of pressure responsive devices adapted to actuate electrical switches.

Pressure switches comprising a snap acting diaphragm disposed in a housing and adapted to move from a first convex configuration in which the central part of the diaphragm bulges toward a pressure source at a pressure below a selected level to a second concave configuration in which the central part of the diaphragm bulges away from the pressure source at pressures above the selected level are well known in the art. Such switches are shown and described in U.S. Pat. Nos. 3,302,269 and 3,584,168, assigned to the assignee of the instant invention. In these prior art switches a motion transfer pin extends through a pin guide from the diaphragm, on the side thereof remote from the pressure source, to a movable contact arm of an electric switch so that when the diaphragm moves from one configuration to the other the electric switch is operated.

Although such switches are very effective and reliable and have been highly successful in the marketplace, there is a need for a pressure switch having certain specific characteristics not found in these switches. In certain automotive applications, such as in air conditioners in which the switches are subjected to a high pressure differential, an especially long life is required, upwards of half a million cycles. The switches set forth in the above patents, at high force and high differentials, have a more limited life, perhaps one or two hundred thousand cycles. In addition, there is a need to produce pressure switches which can be produced less expensively.

Among the several objects of the invention may be noted the provision of pressure responsive devices which have improved life expectancy, devices which are inexpensive to produce and are conducive to mass manufacturing techniques. Another object of the invention is the provision of a method of calibrating pressure responsive switches. Other objects will be in part apparent and in part pointed out hereinafter. The invention accordingly comprises the elements and combinations of elements, steps and sequence of steps, features and structures of manipulation, and arrangements of parts, all of which will be exemplified in the structures and methods hereinafter described, and the scope of the application of which will be indicated in the appended claims.

Briefly, pressure responsive switches are made in accordance with the invention by providing a base member having an open end and a snap acting disc seat formed in the open end thereof. A precalibrated disc is received at the seat and may be taped thereto with pressure sensitive adhesive tape to prevent accidental dislodgement therefrom. A thin flexible gasket membrane is disposed over the open end of the base and is sealingly clamped thereto by a cap. The base may be provided with surface areas disposed at a selected distance from the seat to obviate deleterious effects of the disc from over pressures. A stationary and a movable contact terminal extend through the bottom wall of the base into a switch cavity. The distal end portion of the movable contact terminal is formed into a laterally extending arm which mounts thereon a laterally extending movable contact arm. The movable contact arm has a contact, preferably having a rounded top surface, mounted on its free end. The distal end portion of the stationary contact terminal is provided with a laterally extending platform with a contact, preferably having a flat top surface mounted thereon. A rocker element is placed between the movable contact arm and the snap acting disc. The rocker element has ears projecting from two opposite sides which are loosely received in vertically extending grooves formed in the base member permitting vertical and rocking movement of the rocker elements. The bottom surface of the rocker element is formed with a smooth curved surface which cooperates with the laterally extending distal end portions of the terminals so that when the disc snaps to a concave configuration in which the bulge faces away from the pressure source the force applied to the movable arm is spread throughout the movable contact arms length. In one embodiment the rocker member is configured so that that actuation force is transferred directly to the movable contact as well as the movable contact arm.

In several embodiments the disc is used as a current carrying member rather than employing a separate movable contact arm.

In the accompanying drawings, in which several preferred embodiments of the invention are illustrated:

Figure 1:
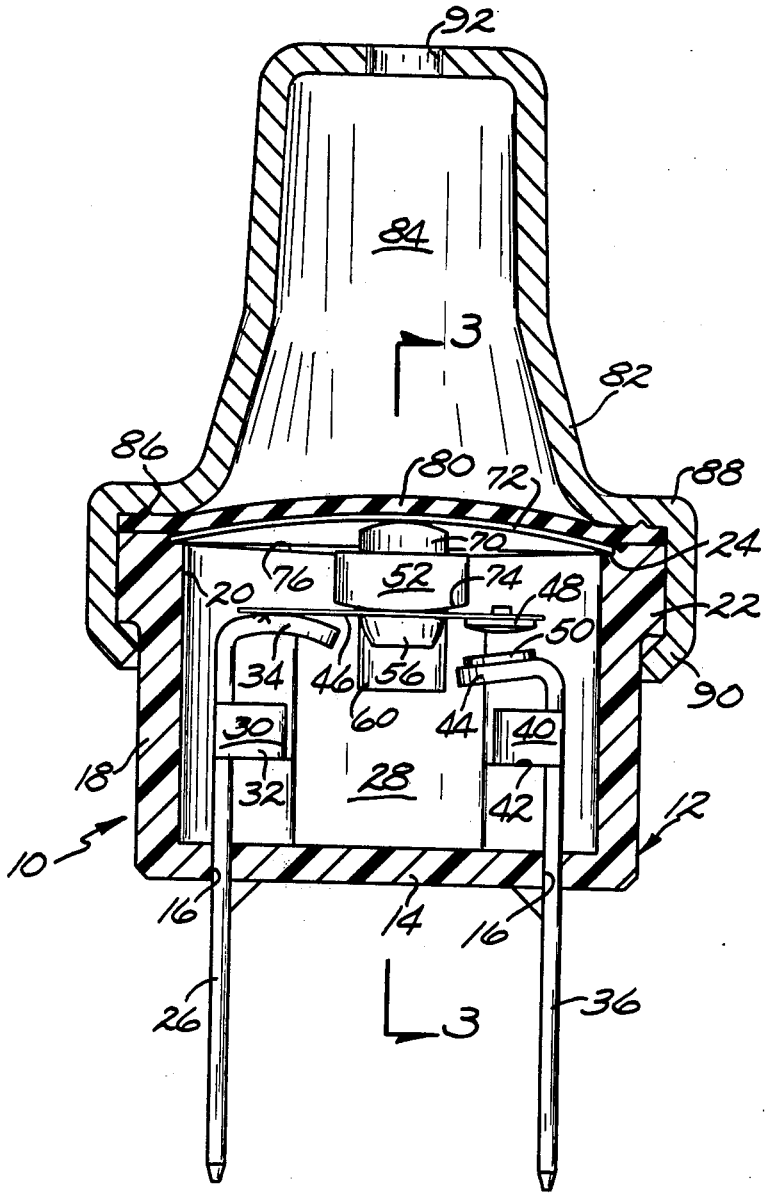
FIG. 1 is a cross sectional front elevation of a device made in accordance with the invention with the electrical contacts in the disengaged position, the rocker member 52 shown with a portion removed for purposes of illustration.
Figure 2:
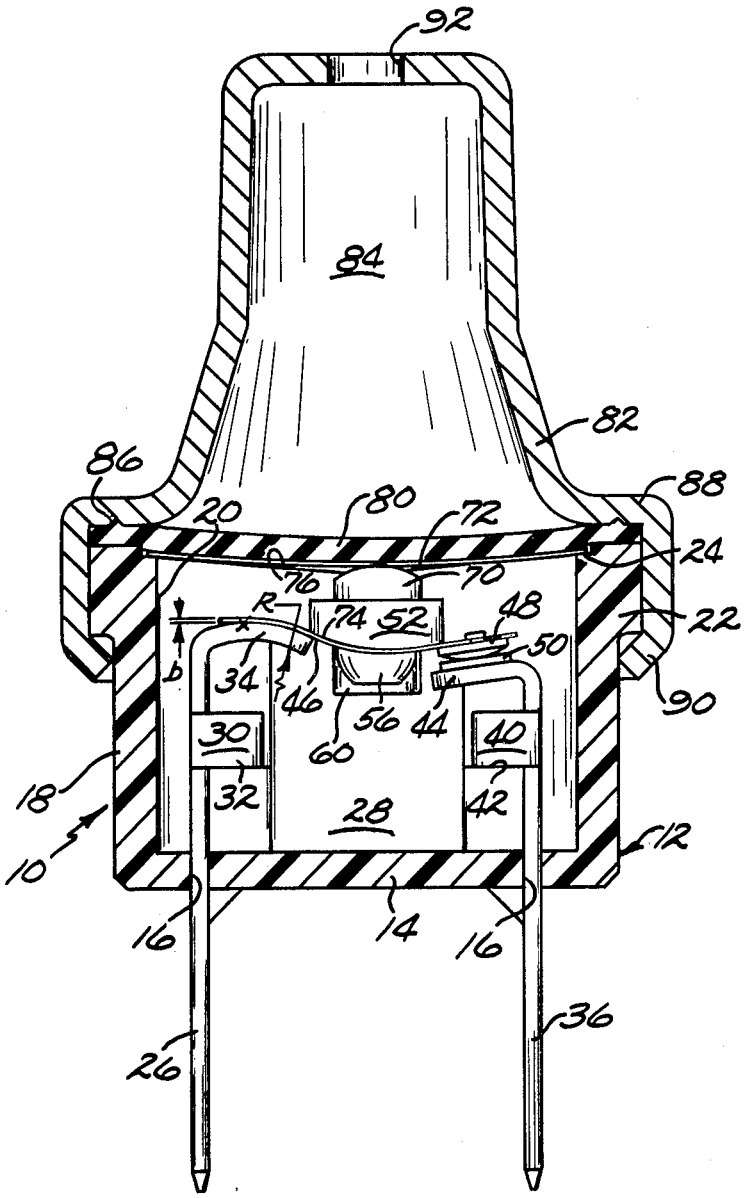
FIG. 2 is a view identical to FIG. 1 but showing the electrical contacts in the engaged position.
Figure 3:
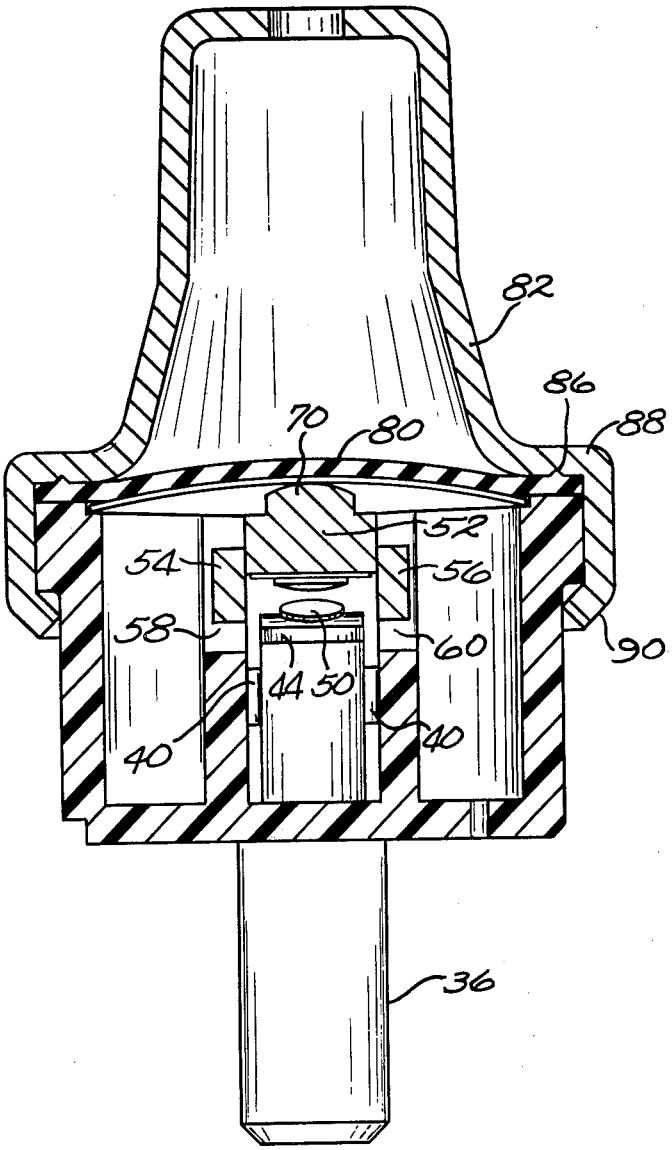
FIG. 3 is a cross sectional view similar to FIG. 1 but rotated 90° about a vertical axis.
Figure 4:
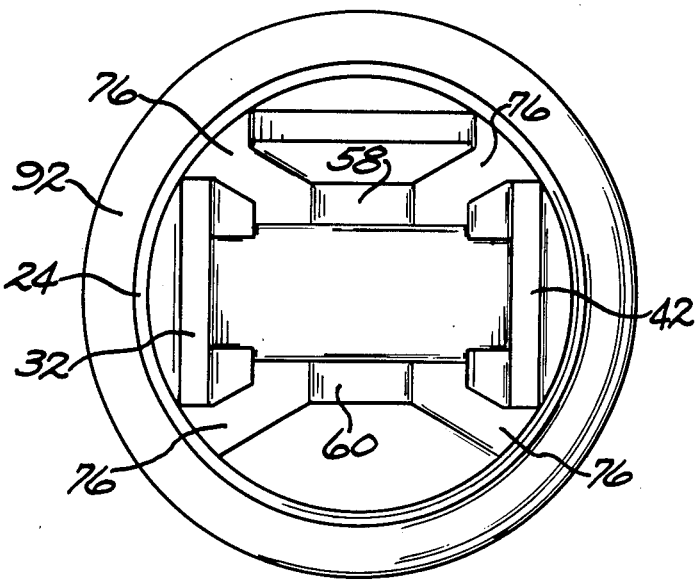
FIG. 4 is a top plan view of the base member and contact assembly used in the FIGS. 1–3 embodiment.
Figure 5A:
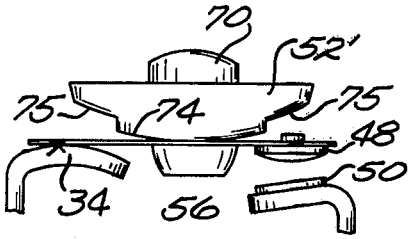
FIG. 5 is a perspective view of a modified rocker member compared to that shown in FIGS. 1–3.
Figure 5:
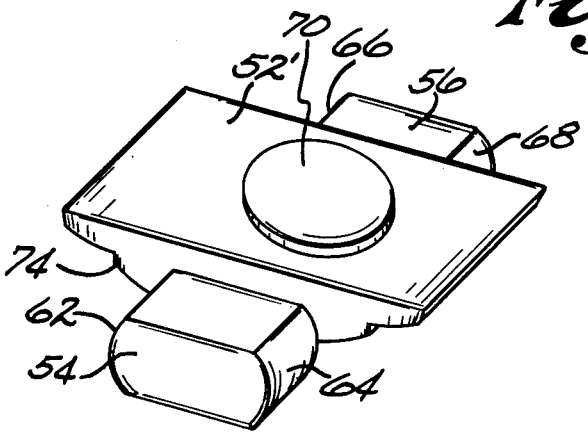
Figure 6:
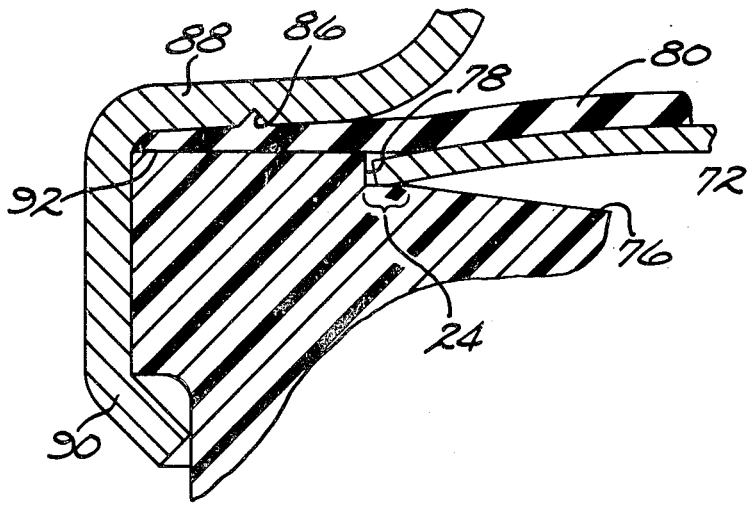
Figure 6A:
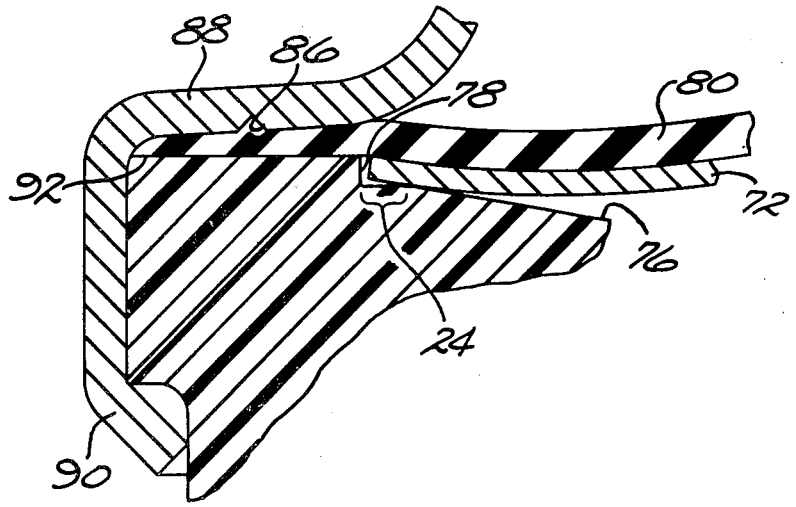
Figure 7:
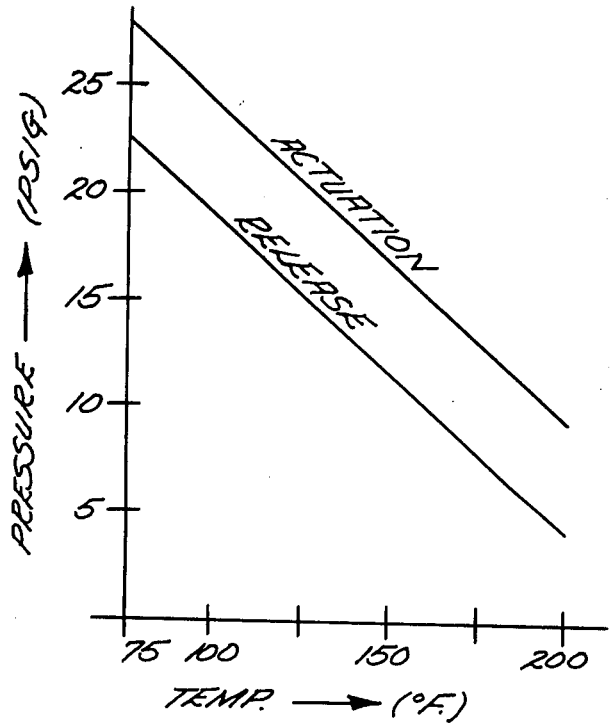
Figure 8:
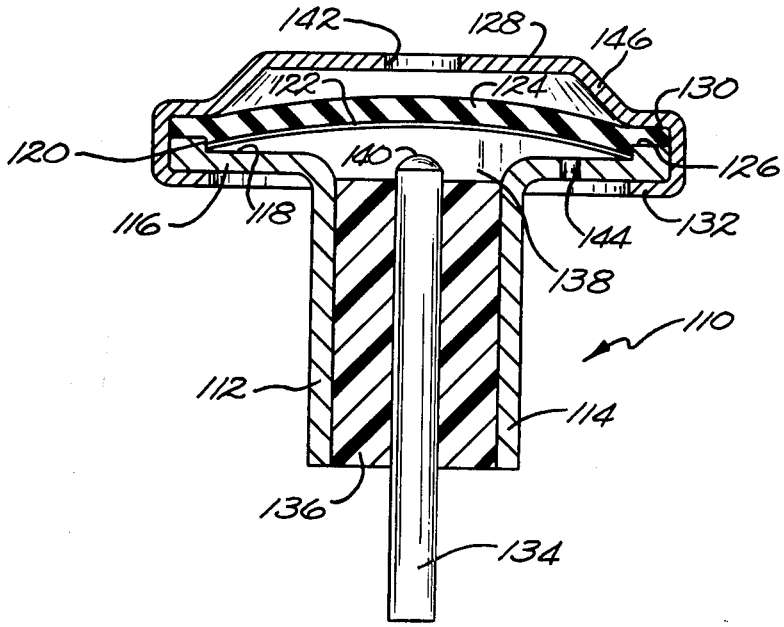

FIG. 5*a* is a view of a portion of the FIGS. 1–3 device as seen in FIG. 1 but with the FIG. 5 rocker member;

FIGS. 6 and 6*a* are enlarged cross sectional views of a portion of the gasket sealing mechanism and the disc seating arrangement used in the embodiment of the previous Figures;

FIG. 7 is a graph showing actuation and release pressure levels of bimetallic discs with different temperatures;

FIG. 8 is a view similar to FIGS. 1 and 2 of a second embodiment of the invention; and FIGS. 9–12 are cross sectional front elevations of additional embodiments of the invention.

Dimensions of certain of the parts as shown in the drawings, and relative movement between parts may have been modified or exaggerated for purposes of clarity of illustration.

Referring now more particularly to the drawings, switch 10 comprises a cylindrical cup shaped base member 12 of conventional electrically insulative, molded plastic such as phenolic material formed with a botom wall 14 having at least two apertures 16 extending therethrough and an upwardly extending sidewall 18, the distal end portion of which defines an open end 20. A flange 22 is formed at the distal end portion of sidewall 18 and may be configured into a hexagonal shape to facilitate handling of the device. Also formed in the distal end portion of sidewall 18 is a disc seat 24 to be described in more detail below.

A terminal 26 extends through one aperture 16 in wall 14 into a switch cavity 28 formed in base 12. Terminal 26 is provided with a pair of tabs 30 which are bent out of the plane of terminal 26 and are disposed in a platform surface 32 to thereby accurately locate the terminal within cavity 28. A laterally extending arm 34 is formed on the distal end portion of terminal 26 and is configured so that it extends downwardly back toward the bottom. Preferably arm 34 is formed with a curved suface for a reason that will be explained below.

A second terminal 36 extends through another aperture 16 in wall 14 into switch cavity 28. Terminal 36 is provided with a pair of tabs 40, similar to tabs 30 of terminal 26, which are bent out of the plane of the main body portion of terminal 36 and are disposed on a platform surface 42 to thereby accurately locate terminal 36 within cavity 28. A laterally extending platform 44 is formed on the distal end portion of terminal 36 and preferably extends downwardly toward the bottom wall forming an acute angle with the main body portion of terminal 36 for a reason to be explained below.

A movable contact arm 46 is attached in a conventional manner, as by welding, to terminal 26 in the vicinity of laterally extending arm 34. Contact arm 46 extends in cantilever fashion toward terminal 36 and mounts at the free distal end thereof a movable contact 48. Movable contact 48 is adapted to move into engagement with a stationary contact 50 mounted on platform 44 when contact arm 46 is forced downwardly and out of engagement with contact 50 when the force is removed. Preferably the contacting surface of contact 48 is rounded while the contacting surface of contact 50 is flat so that upon engagement of contact 48 with contact 50 there is little or no twisting moment applied to contact arm 46. This is an important consideration when longevity of the contact arm is to be optimized.

A force transfer rocker member 52, is disposed on top of and contiguous to contact arm 46. While member 52 may be physically attached to arm 46 it is preferred that it merely rests thereon. Rocker member 52 is provided with ears 54, 56 extending from opposite sides thereof which are adapted to slidingly fit into opposed grooves 58, 60 formed in side wall 18 of base member 12 (see FIG. 3). The width of grooves 58, 60 is somewhat larger than that of ears 54, 56 so that a pivoting motion of rocker 52 within the grooves is permitted. In addition, opposed walls 62, 64 of ear 54 and 66, 68 of ear 56 are formed with outwardly curved surfaces to facilitate this pivoting motion. Rocker member 52 is also provided with a motion transfer projection 70 on the top thereof which contacts the bottom suface of a snap acting disc 72 disposed in disc seat 24 and a smooth curved surface 74 on the bottom thereof.

When disc 72 snaps from the convex configuration in which the central portion of the disc bulges toward a pressure source as shown in FIG. 1 to a concave configuration in which the central portion of the disc bulges away from the pressure source as shown in FIG. 2, rocker member 52 is forced downwardly concomittantly forcing contact arm 46 to bend downwardly. As contact arm 46 deflects an increasing portion of bottom surface 74 comes in contact with the arm 46 thereby distributing the force expended by disc 72 through the entire free length of the arm. Arm 34 of terminal 26 and platform 44 of terminal 36 are so disposed that when disc 72 is in its concave, FIG. 2 position, a smooth curve is formed from the cantilever mount to contacts 48, 50. The pivoting feature of member 52 allows it to more evenly distribute the force throughout the length of contact arm 46. When contact arm 46 moves downwardly contact 48 strikes the uppermost surface of flat contact 50 and immediately starts to cant or pivot while sliding down the top surface of contact 50 until it assumes the position shown in FIG. 2.

An end of life failure mode of the switches set forth in the above noted Pat. Nos. 3,302,269 and 3,584,168 is breakage of the movable contact arm caused by repeated impact forces of the disc through the transfer pin. This situation is exacerbated when the switches are used having discs with a wide differential between actuation and release pressure levels. According to the present invention the provision of rocker member 52 in conjunction with laterally extending curved arm 34 and angularly disposed stationary contact 50 completely obviates this mode of failure. As best seen in FIG. 2, stress is distributed evenly throughout the length of arm 46. As rocker arm 52 is caused to move downwardly from the FIG. 1 position to the FIG. 2 position arm 46 follows the support surfaces that limit the stress on arm 46 by forming the curve of arm 34 and surface 74 of rocker member 52 with a radius no smaller than the determined by the following formula:

$$R = (Eb/2S)$$

where $E$ = modulus of elasticity of contact arm 46

$b$ = material thickness of contact arm 46

$S$ = stress on contact arm 46

Overstress forces are transferred from arm 46 to the terminals which are made strong enough to be subjected to such forces without any deleterious effects.

FIG. 5 shows a modified rocker member 52' in which the body member is lengthened so that it extends over movable contact 48. Surface 74 is recessed at 75 to provide space for the back of contact 48 and is so located that it will strike the back of contact 48 upon snapping of disc 72 while almost allowing arm 46 to the bottom and thereby providing additional contact force and limiting contact bounce. Recesses 75 are provided at opposite ends of member 52' so that orientation of the member in the switch is not critical.

A protective support surface 76 formed from side wall 18 of base 12 is provided adjacent the open end thereof. Surface 76 is contoured such that motion of disc 72 will be limited upon over pressure conditions so that the calibration of the disc will not be deleteriously effected. As can best be seen in FIG. 6, surface 76 forms a slight angle with disc seat 24, which is an annular shaped area lying in a plane generally parallel to the bottom wall 14, to allow disc 72 to snap from the FIG. 1 configuration to the FIG. 2 configuration; however, surface 76 is sufficiently close to the disc when in the FIG. 2 configuration to prevent excessive bulging of the disc during overpressure.

As seen in FIG. 6 a shoulder 78 defines the outer perimeter of disc seat 24 and is formed slightly larger than the disc 72 so that the disc freely sits in seat 24. The inner diameter of seat 24 is chosen relative to shoulder 78 so that the outer perimeter of the disc cannot rest on surface 76. The juncture of surfaces 76 and 24 serves as the disc support when in the FIG. 2 configuration and the surface against which the disc reacts when it snaps back to the FIG. 1 configuration.

A membrane 80 of soft, flexible gasket material, such as neoprene rubber, is placed over the open end of base 12 and cap member 82 is clampingly received over flange 22 to seal switch cavity 28 from a pressure chamber 84 formed within cap 82. In order to ensure an effective seal, cap 82 is formed with an annular groove 86 in shoulder 88. Cap 82 is placed over the gasket 80 on the open end of base 12 and forced firmly against it. The lower portion 90 of cap 82 is then crimped to lock the cap to the base. The pressure of shoulder 88 against gasket 80 causes the gasket material to fill groove 86 thereby enhancing the seal. Further, it is preferred that shoulder 88 and surface 92 of base member 12 converge the direction toward the outer periphery so that the outer extremities of gasket 80 are under greater sealing forces than the portions thereof adjacent groove 86.

Cap 82 may be connected to a source of pressure to be monitored through orifice 92. Thus at pressures below a selected level disc 72 is in the FIG. 1 configuration with the bulge of the disc facing the pressure source; however, upon an increase of pressure to the selected level the disc suddenly snaps through to the FIG. 2 configuration with the bulge of the disc facing away from the pressure source and causing contacts 48–50 to engage one another.

Devices made in accordance with the invention not only have enhanced life expectancy due to the rocker member and cooperating terminal configuration they offer another advantage compared to those set forth in the above referenced patents. In these patents various techniques had to be employed during assembly of the devices in order to calibrate them to the desired specification. In U.S. Pat. No. 3,584,168, for instance, a calibration-stop member located adjacent the snap acting disc 76 is deformed a desired amount to effect calibration. In U.S. Pat. No. 3,302,269 a diaphragm is placed intermediate two casing members whereby the diaphragm separate each of the compartments from each other after which fluid pressure is applied in one of the cavities against the diaphragm to stress and deform the diaphragm into a snap acting configuration. In accordance with the present invention snap acting disc 72 is precalibrated for both actuation and release pressures so that no further calibration of the device is required. It has been found that actuation and release pressures can be controlled very closely, within plus or minus 2 pounds per square inch up to as high as seventy pounds per square inch actuation pressure. The particular structure which makes this possible includes the disc seated in the shallow recess of seat 24 and trapped therein by gasket 80 in such a way that the sealing of the gasket through the clamping action of shoulder 88 of cap 82 does not have any significant effect on the disc operation. The center portion of the disc recess, surface 76 is configured so that it supports the disc only during over pressures while still permitting the disc to creep off surface 76 as the over pressure decreases prior to disc 72 snapping back to its FIG. 1 configuration. During assembly the disc is preferably maintained in its seat by placing a strip of pressure sensitive tape over the disc and onto top surface 92 of base member 12. This tape has no significant effect on the operation of the disc and has the advantage of ensuring that the disc does not become dislodged during manufacture, during handling or while in use. Alternatively a layer of pressure adhesive material could be applied directly to the under surface of gasket member 80.

Disc 72 is blanked preferably in circular shape from either monometallic material such as stainless steel or bimetal if a temperature bias is desired. The blank is formed into a snap-acting disc by means known in the art; basically, it involves forming a non-developable surface by permanently deforming the disc. The edges of the discs are rounded off, as by tumbling, to avoid cutting into gasket 80. The diameter of the disc compared to the diameter of shoulder 78 of the disc seat recess is selected so that the disc fits freely therein but not so loosely that gasket 80 is extruded into the space between the disc and shoulder 78 to avoid having the gasket abraded or cut by disc movement.

During operation of the device when a monometallic disc 72 is employed, it snaps from the FIG. 1 configuration to the FIG. 2 configuration when a selected level of pressure is introduced into chamber 84 through orifice 92 and snaps back when the pressure decreases to a second selected level of pressure.

In certain instances it may be desirable to change the selected levels of actuation and release based on changes in temperature as suggested in U.S. Pat. No. 3,584,168. In that patent a snap acting diaphragm can be composed of bimetal so that the switch will respond to temperature as well as pressure however it is difficult to calibrate the switch to obtain the desired temperature-pressure relationship. That is, although the diaphragm may be formed into a snap acting device according to conventional techniques so that it will snap and reset at selected temperature levels that is changed when the calibration stop member is bent to obtain the desired pressure calibration of the diaphragm. In the present invention, however, temperature bias can be obtained for a disc which is precalibrated for desired pressure actuation and release levels by choosing various particular bimetal material combinations and thicknesses. As seen in FIG. 7, pressure switches having discs composed of identical material combinations and thicknesses show an approximate linear rate of decrease of actuation and release levels with increasing temperature of 13 psig per 100° F. Similar plots can be developed for other material combinations and thicknesses so that virtually any temperature bias can be selected merely by choosing a precalibrated pressure disc of the appropriate material combination and thickness and employing it in the switch since the switch need not be further calibrated.

A typical switch made in accordance with the invention employs a disc having a diameter of 0.750 inch. The ledge or seat area 24 has a width between 0.020 and 0.025 inch. Approximately 0.005 inch between the disc and shoulder 78 is allowed to permit the disc to fit freely in its seat while preventing extrusion of gasket 80 therebetween. The maximum depth of the recess seat 24 relative to surface 92 is approximately twice the thickness of disc 72 so that two discs can be employed for particularly high pressure actuation levels. It will be understood that the depth can be chosen so that more than ten discs can be used if so desired.

The base is produced from a mold so that the disc seat surface and terminal mounting surfaces are determined from a reference plane on the same side of the mold which permits extremely accurate location of the several parts of the switch once assembled. That is, the top surface of platforms 32 and 42 are referenced from surface 24 so that very precise relationship of contacts 48–50 relative to disc 72 is realized. This precise dimensional relationship enables the employment of precalibrated discs without the requirement of further calibrating means. Of course additional adjustment could be provided if one desired to produce a switch which could be adjustably calibrated by means of conventional springs or stops located on either side of the discs.

Another advantage the present invention offers is that the switch can be tested for actuation and release pressure levels as well as over pressure with the electrical contact assembly installed whereas in typical prior art switches, as set forth for instance in U.S. Pat. No. 3,584,168, the switches would have to be tested without their contact assemblies so that information obtained would inherently be less reliable than in switches of the present invention.

FIGS. 8–12 show several other embodiments in which a precalibrated free disc is used in a pressure switch. With particular reference to FIG. 8 a switch 110 comprises base member 112 including an eyelet portion 114 and a bottom wall 116. A preferably circular recessed seat portion 118 is defined in wall 116 by an outer peripheral shoulder 120. The height of shoulder 120 is preferably chosen to accommodate several discs 122 although only one disc is shown in the drawing. Gasket 124 of a flexible material such as rubber is disposed on top of disc 122 and extends onto the outer flange portion 126 of base 112. Cap 128 is received over gasket 124 with annular flange portion 130 clampingly engaged with the outer peripheral margin of gasket 124 by turning the free distal end of wall 132 of cap 128 over base 112. A terminal pin 134 is mounted in eyelet 114 and electrically isolated therefrom by electrically insulating material 136 of glass, epoxy or other suitable material. Pin 134 extends into a chamber 138 formed beneath disc 122 and has a terminus portion 140 which serves as an electrical contact. Base member 112 is formed of electrically conductive material such as brass that disc 122 serves to close and open an electrical circuit between pin 134 and base 112 by conducting current therebetween when sufficient pressure is introduced through aperture 142 in cap 128 to cause disc 122 to bow with snap action toward and into contact with pin 134 and out of contact with pin 134 when the pressure level received through aperture 142 is less than a selected level so that the disc snaps back away from the pin as shown in FIG. 8. A small aperture 144 is provided in bottom wall 116 to vent chamber 138. As in the FIGS. 1–7 embodiment, recess 118 is sloped slightly to permit disc 122 to snap to the contacts closed configuration.

Gasket 124 is employed to seal the switching assembly from the pressure source and is therefore tightly secured all about its periphery between flange 130 and the bent over portion 132 of cup 128, however in ordr to avoid affecting the calibration of disc 122, the actuation and release pressure levels, cap 128 is flared away from the disc at 146 so that the only restraint on the disc itself is the contiguous flexible gasket which effect has been found to be negligible. As in the previous embodiment flanges 126 and 130 may tend to converge as the other peripheral edges are approached in order to optimize the sealing effect. Additionally, although not shown, a groove may be formed in one of the flanges, if desired, to further enhance the seal.

The above switch could, for instance, be advantageously used as a low tire pressure switch mounted by means of a conventional grommet into the tire wheel from the inside out with cap 128 facing inwardly. The base 112 and pin 134 could be included through conventional connections in an electrical circuit having a warning light or other signal means so that when the tire is pressurized above a preselected level the disc is forced into the closed contacts position.

Figure 9:
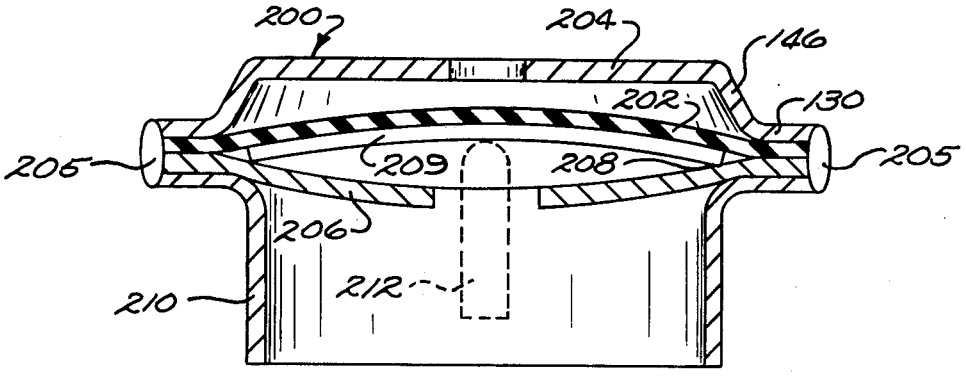

In FIG. 9 a hermetic seal is obtained in switch 200 by employing a thin metallic membrane 202 which is welded to cap 204 along the outer periphery thereof as shown at 205. Membrane 202 may be formed of 0.001 to 0.002 inch stainless steel as a suitable example. Switch 200 also includes a disc support member 206 which is formed with a seat portion 208 configured to accept the number of free discs 209 required to obtain the desired actuation pressure. Cap 204, disc support 206 and case member 210 are made of any suitable material which can be readily stamped and welded, such as cold roll steel. As in the previous embodiments, cap 204, as well as support 206 are formed so that they exert no additional forces on disc 209 to thereby effect the disc calibration. The switching mechanism 200 can be used with any standard electrical switch as indicated by motion transfer element 212 shown in phantom in addition to that shown in the previous embodiments. It will be noted that since disc 209 is spaced from weld 205 the calibration of the disc 209 is not affected.

Figure 10:
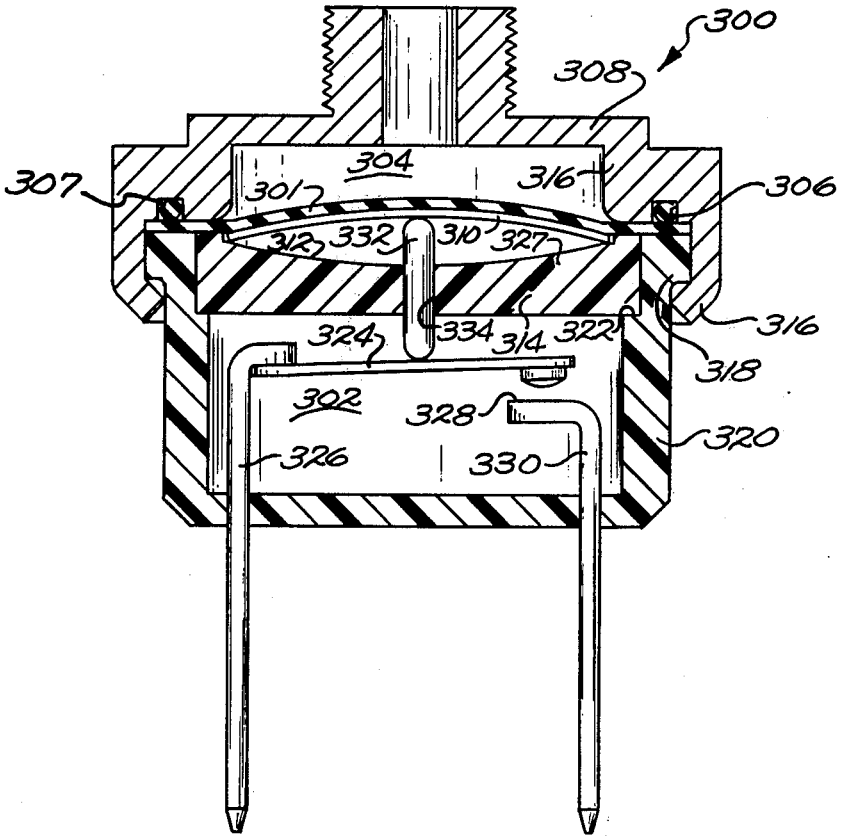

FIG. 10 depicts a switch 300 which is particularly useful in systems in which the pressure source comprises a substance which is not compatible with the rubber type gasket used in the non-hermetic seals in the previous embodiments. An example of such a substance commonly used, e.g. in air conditioning systems, is freon. As seen in FIG. 10, a thin metallic diaphragm 301 of stainless steel or the like, similar to that shown in FIG. 9, or plastic film such as Kapton, separates the switch chamber 302 from the pressure chamber 304. An annular channel 306 is formed in cap 308 and receives therein a flexible "O"-ring 307 composed of rubber or similar material. Since the rubber is completely enclosed by the cap and membrane the seal will be effective since the swelling of the rubber under the action of freon will be limited to the cross sectional area of the channel.

Disc 310 is received beneath diaphragm 301 in a recessed portion 312 of disc support 314. The recessed portion 312 is configured in the same manner as are the corresponding disc support members in the previous embodiments. Further, the inside wall 316 is located so that its places no force on disc 310. Cap 308 is formed with a downwardly extending wall 316 which is clamped onto flange 318 formed on the open end of a cup shaped base member 320. A shoulder 322 is located on the inside of the base member 320 and receives thereon disc support 314. Also disposed in base member 320 is a conventional switch mechanism comprising a movable contact arm 324 attached to a terminal member 326. A stationary contact 328 is disposed on a second terminal member 330. Motion transfer pin 332 is disposed between disc 310 and movable contact arm 324 and is slidably inserted in a bore 334 formed in disc support 314 so that motion of disc 310 is transferred to movable arm 324 to cause contact closure when the disc snaps to the configuration opposite to that shown in the Figure. A conventional switch mechanism such as that just described is suitable when the actuation pressure is relatively low or when it is not needed to subject the switch to a great number of cycles in contradistinction to the FIGS. 1–7 embodiment.

Figure 11:
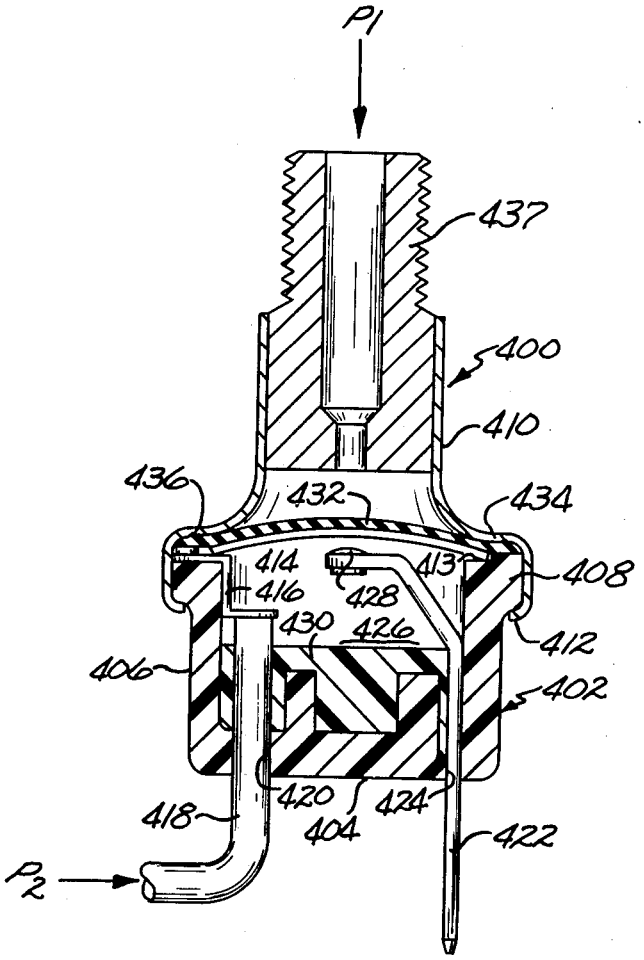

In FIG. 11 differential pressure switch 400 useful in oil and fuel filter systems for example, is shown comprising a generally cup shaped base 402 of any suitable electrically insulative material having a bottom wall 404 and a sidewall 406 attached thereto. A flange 408 is formed in the free distal end portion of wall 406 to facilitate attachment of cap 410 to base 402 by turning the bottom portion 412 over flange 408. A recessed annular disc seat 413 is formed in wall end portion 406 and receives therein a precalibrated, free disc 414 formed of stainless steel or other suitable elecrically conductive material. An electrically conductive bracket 416 extends from disc seat 414 supporting and electrically connecting a capillary tube 418 formed of suitable electrically conductive material. Tube 418 extends through an aperture 420 formed in bottom wall 404. A terminal 422 extends through a second aperture 424 in bottom wall 404 into a switch chamber 426 and mounts at its free end a stationary contact 428 disposed generally at the center of disc 414. Disc 414 is adapted to move with snap action from the outwardly bowed, convex configuration shown in FIG. 11 in which contact 428 is spaced from disc 414 to an inwardly bowed, concave configuration in which contact 428 is in engagement with disc 414 to complete an electrical circuit from tube 418 to bracket 416, disc 414, contact 428 and terminal 422. Tube 418 and terminal 422 are sealed in their respective apertures by means of electrically insulative potting material 430.

Gasket 432 of flexible rubber or rubber like material is disposed on top of base member 402 over disc 414 and is sealingly clamped thereto by cap 410. The seal is preferably enhanced in the same manner as in previous embodiments by employing converging surfaces of the outer end of wall 406 and cap portion 434 aligned therewith as well as groove 436 formed in cap portion 434. Again care is taken to ensure that cap 410 does not exert any force on disc 414 but only on gasket 432 by flaring the cap wall away from the disc at it approaches the outer perimeter of the disc. Cap 410 is sealingly attached to a threaded nipple 437 as by welding thereto although it will be appreciated that cap 410 and nipple 437 could be formed out of a single member if so desired.

Nipple 437 is connectable to a first pressure $P_1$ while capillary tube 418 is connectable to a second pressure $P_2$. Thus the configuration of disc 414 will be determined by the pressure differential between $P_1$ and $P_2$. When $P_1$ is sufficiently greater than $P_2$ disc 414 will snap from the convex configuration shown to an opposite concave configuration and will snap back again when the difference between the pressures decreases to a selected level.

Figure 12:
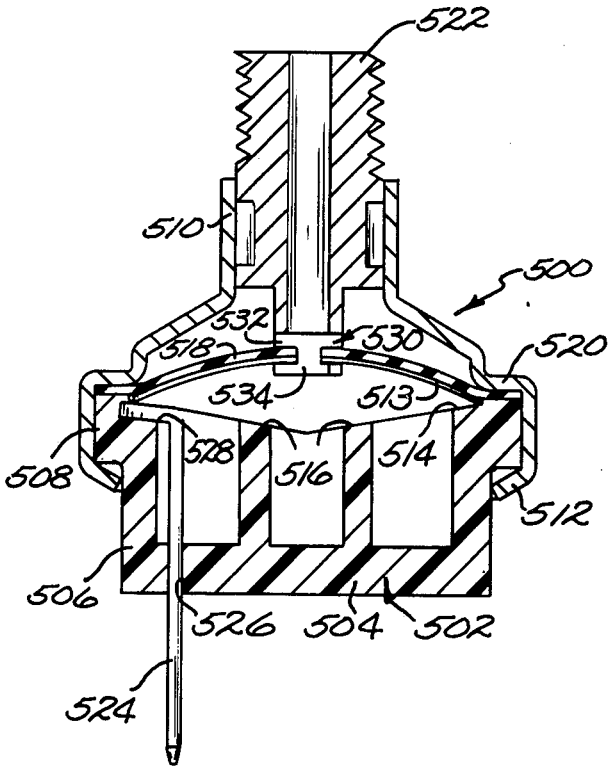

FIG. 12 shows yet another embodiment employing a precalibrated free disc in which the electrical switching circuit is completed from the base side of the switch to the cap through the disc element. Switch 500 comprises a generally cup shaped base 502 having a bottom wall 504 and an upstanding side wall 506 attached thereto. A flange 508 is formed on the distal free end of wall 504 to facilitate attachment of cap 510 by turning over end portion 512. A recessed disc seat 514 is formed in distal end portion of wall 506 to accomodate a selected number of discs 513 which fit therein in the same manner as in the previously described embodiments. Over pressure protection for disc 513 is provided by surface 516. Gasket 518 is placed over the open end of base 502 and is sealingly clamped thereto by flange portion 520 of cap 510 in the same manner as in the above described embodiments. A threaded electrically conductive nipple 522 is attached to cap 510 in any suitable manner as by welding to form an effective seal therebetween and is connectable to a pressure source. Terminal 524 extends through aperture 526 formed in bottom wall 504 and terminates in a groove 528 formed in wall 506 contiguous with disc seat 514 so that disc 513 and terminal 524 are in electrical connection. A rivet like electrically conductive connector 530 extends through a centrally located aperture in gasket 518 and disc 513 and is turned over at its opposite ends to form opposed collars 532, 534 which grasp the gasket and disc. A seal is formed between collar 534 and disc 513 as by welding.

Thus an electrical circuit extends from terminal 524 through disc 513 connector 530 to nipple 522 when the disc is in its upwardly bowed, convex configuration shown in FIG. 12. When a selected level of pressure is introduced to the switch through nipple 522 disc 513 with snap to its opposite inwardly bowed, concave configuration and cause connector 530 to separate from niple 522 thereby breaking the circuit. Even though rivet 530 is connected to disc 513 it does not materially change the precalibrated actuation and release pressure levels of the disc since in all other respects it rests freely in its seat.

Thus it will be seen, according to the present invention, a precalibrated disc is employed in such a manner that additional calibration of the switch is not required making assembly of the switch much less costly and more convenient. Several sealing means are shown to meet varying needs. An improved motion transfer mechanism is disclosed which results in significantly improved useful life of the switch. Although only single pole, single throw switches are described it will be appreciated that double pole or double throw switches can be provided just as readily by adding appropriate terminal members.

In view of the above, it will be seen that the several objects of the invention are achieved and other advantageous results attained.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

We claim:

1. A condition responsive device comprising a base formed of electrically insulative material defining a switch chamber therein, a switch means disposed in the chamber including a movable contact arm and first and second terminal members, the movable contact arm cantilever mounted on a distal end of the first terminal member and having a free end portion mounting a movable contact thereon adapted to move into and out of electrical engagement with a distal end of the second terminal member, the movable contact having the contact engaging surface on one side of the movable contact arm and a portion extending through and projecting from an opposite side of the movable contact arm, means defining an opening in the base communicating with the switch chamber, condition responsive means mounted at the open end of the base adapted to move from a first position to a second position and back upon being exposed to preselected conditions to respectively close and open an electrical circuit from the first terminal through the movable contact arm to the second terminal, and a motion transfer member slidably disposed intermediate the movable contact arm and the condition responsive means, the member having a curved bottom surface extending over a major portion of the length of the movable contact arm so that movement of the condition responsive means from the first position to the second position causes the motion transfer member to bend the movable contact arm to conform to the bottom surface configuration of the motion transfer member to thereby distribute impact forces from the condition responsive means along the length of the movable contact arm, and a recess formed in the curved bottom surface to receive therein the projecting portion of the movable contact when condition responsive means is in the second position.

2. A condition responsive device according to claim 1 in which the curved bottom surface of the motion transfer member extends from a first side aligned with the distal end of the first terminal member to a second side aligned with the movable contact.

3. A condition responsive device according to claim 2 in which a recess is formed in the bottom surface at both the first and the second side.

4. A condition responsive device according to claim 2 in which the depth of the recess is selected so that the member hits the projecting portion of the movable contact when the condition responsive means is in the second position.

5. A condition responsive device according to claim 1 in which guideways comprising opposed vertically extending grooves are formed in the base member and the motion transfer member is provided with a pair of ears each of which fits into a respective groove to maintain the motion transfer member in alignment with the movable contact arm.

6. A condition responsive device according to claim 5 in which the ears are formed with first and second opposed curved surface portions which loosely fit into the grooves so that the motion transfer member can readily pivot to evenly distribute forces transmitted therethrough.

7. A condition responsive device according to claim 1 in which the curved surface of the motion transfer member has a radius selected according to the formula $$R = Eb/2S$$

where $E$ equals the modulus of elasticity of the movable contact arm $b$ equals the thickness of the movable contact arm $S$ equals the maximum desired level of stress to which the movable arm is to be subject.

8. A condition responsive device according to claim 7 in which the distal end of the first terminal is located on a laterally extending portion which is formed with a surface portion which curves downwardly away from the condition responsive means.

9. A condition responsive device according to claim 8 in which the curved portion of the first terminal has the same radius as the bottom surface of the motion transfer member.

10. A condition responsive device according to claim 8 in which the distal end of the second terminal extends downwardly away from the condition responsive means so that the movable contact arm forms a smooth curve when the condition responsive means is in the second position.

* * * * *